United States Patent [19]

Handley et al.

[11] 4,286,608

[45] Sep. 1, 1981

[54] HAIR ROLLER

[75] Inventors: Charles L. Handley, Dearborn; James R. Ostheim, Ferndale, both of Mich.

[73] Assignee: Charade Hair and Skin Care Center, Inc., Dearborn, Mich.

[21] Appl. No.: 777,170

[22] Filed: Mar. 14, 1977

[51] Int. Cl.[3] ..... A45D 2/00

[52] U.S. Cl. ..... 132/40

[58] Field of Search ..... 132/40, 39, 42

[56] References Cited

U.S. PATENT DOCUMENTS

| | | | |
|---|---|---|---|
| 1,042,886 | 10/1912 | Buickerood | 132/40 |
| 2,852,029 | 9/1958 | Steele | 132/42 R |

FOREIGN PATENT DOCUMENTS

| | | | |
|---|---|---|---|
| 868214 | 7/1949 | Fed. Rep. of Germany | 132/42 |
| N 9032 | 5/1956 | Fed. Rep. of Germany | 132/40 |
| 578817 | 7/1958 | Italy | 132/40 |
| 579290 | 7/1958 | Italy | 132/40 |

*Primary Examiner*—G. E. McNeill

*Attorney, Agent, or Firm*—Krass, Young & Schivley

[57] ABSTRACT

An improved hair roller is disclosed comprised of a hollow spindle having flared end portions formed thereon with a series of notches provided about the periphery of one of the flared ends of the hollow spindle and a pair of radially opposite notched holes provided on the periphery of the other flared end of the spindle. An anchoring clip is provided having a loop section maintained within the one flared end of the hollow spindle, the anchoring clip having an elongated projection disposed in one of the radially extending notches extending radially outward of the spindle. A retention pin disposed in the notched hole pair formed in the opposite flared end serves to retain an elastic element secured to the loop section and to the retention pin, resiliently maintaining the loop section within the one end portion of the spindle. The radially outward extending projection on the anchor clip serves to prevent the unwinding of the hair roller after a hair curl has been wound on the spindle body, by engagement with the scalp of the user. The anchoring clip is adapted to be readily adjusted in angular position to properly engage the user's scalp by partially withdrawing the loop section from the spindle by the extension of the resilient element and relocating the projection element in the appropriately located radial notch.

1 Claim, 5 Drawing Figures

HAIR ROLLER

BACKGROUND OF THE INVENTION

1. Field of the Invention

This invention concerns hair rollers of the type in which curls are formed by winding locks of hair on a spindle body.

2. Description of the Prior Art

It has been previously suggested, as described in U.S. Pat. No. 2,747,584 to Polykranas to provide a hair roller in which the hair curl is not clamped or otherwise secured to the roller in such a manner as to prevent the roller from unwinding after a curl has been wound on the roller. In this approach, a transversely extending pin member was provided adapted to mate with any of a plurality of holes extending radially through a spindle member, the pin member when in engagement with the scalp of the user, anchoring the roller to prevent it from unwinding, thus obviating the need for a direct clamping of the hair curl. This approach, eliminating the direct application of a clip or bar with the curl, enhances the quality of the curl produced.

However, in this hair roller design, the pin is a discrete element of the hair roller and is not secured to the hair roller spindle, necessitating a troublesome and time-consuming assembly of the spindle and pins during use. Another disadvantage arises from the need to adjust the angular position of the anchor pin, to properly anchor the spindle at the particular final position of the spindle after winding of the curl. This adjustment of the pin position in the hair roller described in the Polykranas patent requires either an assembly of the pin and spindle at the time the spindle is anchored or else a complete withdrawal of the pin to relocate the same in the proper position. Since many rollers are utilized in providing the typical hair set, this procedure is relatively time-consuming and cumbersome which is a substantial drawback in the context of professional hair dressing businesses.

Accordingly, it is an object of the present invention to provide a hair roller of the type described in which the curl is not directly clamped to the hair roller in order to prevent the unwinding of the curl from the roller and in which the hair roller does not involve discrete components, which are of necessity assembled and disassembled during the hair setting process.

It is another object of the present invention to provide such a hair roller in which the hair roller anchoring means is very quickly and easily adjusted in angular position to properly anchor the hair roller.

SUMMARY OF THE INVENTION

These and other objects of the present invention which will become apparent upon reading of the following Specification and Claims is provided by a hair roller structure comprised of a hollow spindle member, adapted to have a lock of hair wound into a curl thereon, and also including an anchor clip having a loop section disposed within one end of the hollow spindle, the anchor clip having a radially outwardly extending projection angularly located with respect to the spindle by virtue of an engagement with one of a series of radial notches disposed about the end portion of the hollow spindle. The anchoring clip is maintained in position within the hollow spindle by means of an elastic element secured to the loop section at one end and passing along the length of the hollow spindle and anchored at its other end by means of a transversely extending retention pin. The angular location of the outwardly extending projection is readily adjusted by partially withdrawing the loop section, against the bias of the elastic element, and relocation of the projection in an appropriately located angular notch. The spindle body has flared end portions with the loop section having a sloping side adapted to be complementary to the flared end section to frictionally engage the loop section with the interior surface of the flared end portion.

DETAILED DESCRIPTION

In the following detailed description contained in the following Specification and drawings, specific terminology will be utilized for the sake of clarity and a particular embodiment described in accordance with the requirements of 35 USC 112, but it is to be understood that the same is not intended to be limiting and indeed should not be so construed, inasmuch as the concept is capable of many forms and variations within the scope of the appended claims.

Figure 1:
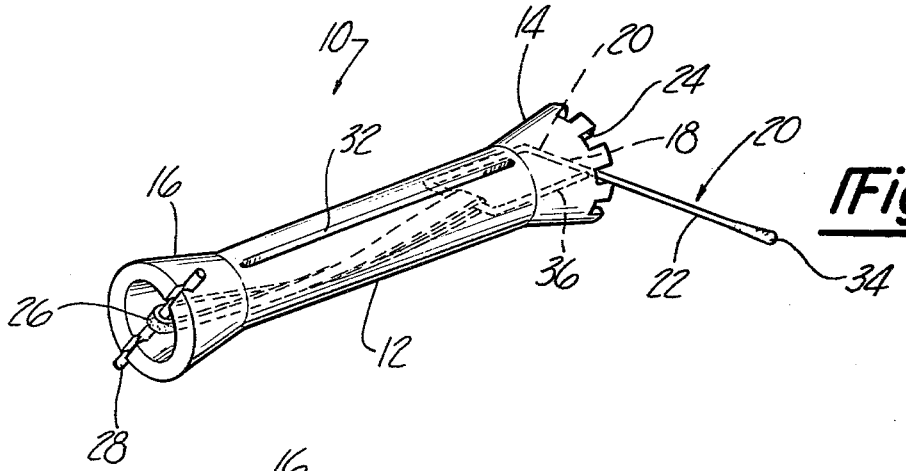
FIG. 1 is a perspective view of the hair roller according to the present invention.
Figure 2:
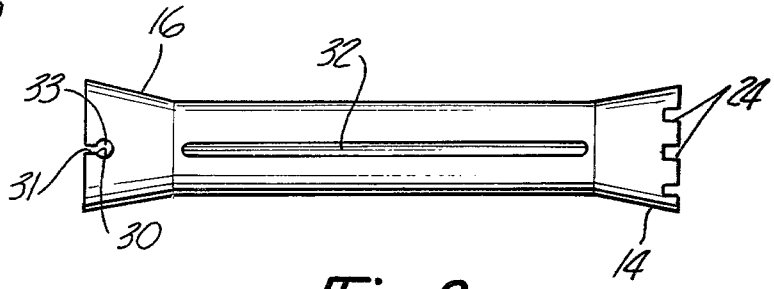
FIG. 2 is an elevational view of a hair roller spindle incorporated in the hair roller shown in FIG. 1.
Figure 3:
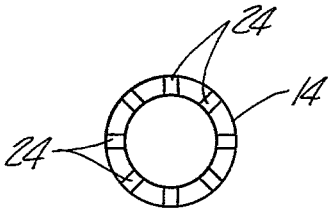
FIG. 3 is an end view of the spindle shown in FIG. 2.
Figure 4:
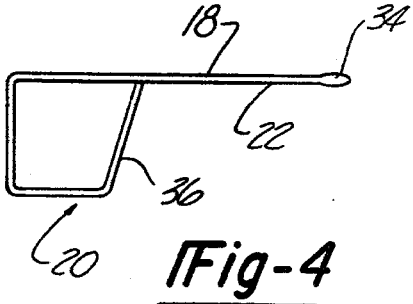
FIG. 4 is a perspective view of an anchoring clip incorporated in the hair roller assembly shown in FIG. 1.

In referring to the drawings and particularly FIG. 1, the hair roller 10 according to the present invention includes a hollow spindle member 12 having flared end portions 14 and 16 to define a central curl receiving body intermediate the end portions 14 and 16. Disposed within one end portion of the hollow spindle 12, is an anchoring clip 18 having a closed loop section 20 disposed within the flared opening provided by the flared end portion 14. The anchoring clip 18 also has a radially extending projection 22, with the angular location of the projection 22 with respect to the flared end portion 14 being determined by seating in one of a series of notches 24 formed about the periphery of the end portion of the flared end portion 14.

Disposed within the interior of the hollow spindle 12 and extending along its length thereof is an elastic element such as a rubber band 26 secured at one end to the loop section 20 of the anchoring clip 18, as shown in FIG. 1, and at the other end retained by means of a transversely extending retention pin 28 received within a pair of notched holes 30 formed in the opposite end flared section 16. The length of the elastic element 26 is such as to securely maintain the anchoring clip 18 in position within the hollow spindle 12 under the influencing of a biasing tension exerted by the elastic member 26 but allows withdrawal of the loop section 20 for relocation of the projection 22.

The hollow spindle 12 is also provided with a slot 32 which is usually provided to allow various liquids to be applied to a curl wound on the spindle body portion 12.

The tip 34 of the projection portion 22 is blunted for safety considerations by the application of a plastic or solder material. The anchoring clip 18 is advantageously provided by a wire form element and has an inclined side portion 36 which is complementary to the taper of the flared end portion 14, so as to frictionally engage the side thereof to cooperate with the projection 22 passing through one of the notches 24 to secure the anchoring clip 18 in any given adjusted angular position. The loop section 20 thus acts by engaging the inside of the hollow spindle 12 to locate the projection 22 radially so as to engage the notches 24 and to maintain its orientation to extend radially out from the spindle 18 while under the influence of the elastic element 26.

The notched holes 30, as shown, are provided by a slot and hole arrangement so that the retaining pin may pass through the slot 31 and a hole 33 so that the pin may be disposed within the hole 33 with a relatively tight friction fit, so as to insure the retention thereof in the end portion 16.

Figure 5:
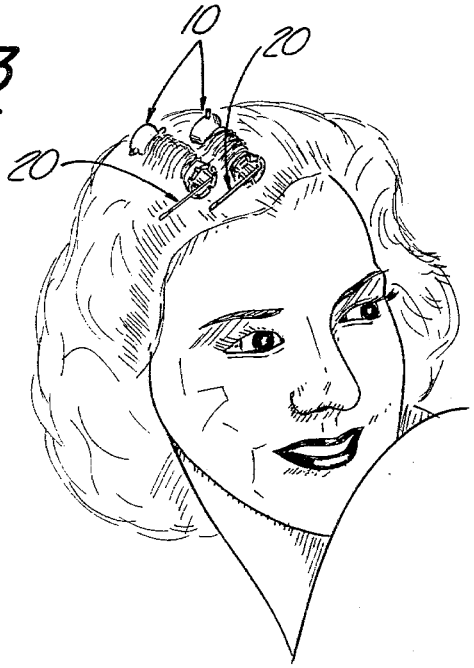
FIG. 5 is a perspective view showing hair rollers in position against the scalp of a user.

In FIG. 5 is shown the application or use of the hair roller. The curl is wound on the hollow spindle 12 intermediate to flared end portions 16 and 14 drawing the curl into proximity with the person's scalp. As the hollow spindle 12 approaches the person's scalp, the anchor clip is manipulated by partial withdrawal of the anchor clip 18 and the loop section 20 from the flared end 14 in which it is disposed out of the particular notch 24 in which it is disposed and, after completion of the winding of the curl, located and released in a position in which the projection 22 is disposed downwardly against the person's scalp, to thereby prevent unrolling of the hollow spindle 12 and curl.

The hair roller 10 is thus securely anchored in position, without the need for clamping of the curl to the spindle.

It can thus be seen that the hair roller 10 obviates some of the disadvantages of the above described hair roller construction in that all the discrete components of the hair roller are retained together, and the angular position of the anchoring clip projection 22 is very readily carried out during the curl forming manipulation, so that a hair set may be carried out very expeditiously.

Numerous modifications of the specific features disclosed in FIGS. 1 through 5 are, of course, possible. The slots 24 may be replaced with serrations to provide a greater degree of adjustment in the angular position of the projection portion 22 or else a frictional engagement of the loop section 20 could be provided by meeting with the interior tapering walls of the end section 14, so as to provide a truly infinite adjustment in the angular position of the anchor clip 18. In addition, anchoring clips could be utilized at both ends of the hair roller to augment the anchoring force available and to provide a more or less symmetrical anchoring force acting on the spindle 12.

The provision of the elastic member 26 and retention pin 28 could also, of course, be substituted with other means for resiliently retaining the anchoring clip loop section 20 within the flared end portion 14 of the hollow spindle 12. Similarly, the specific configuration of the anchor clip 18 could be varied in many ways, i.e., the anchor clip 18 could be retained to the spindle body in such a manner as to provide a frictional securement so as to be rotatable in the end portion and a friction snubbing arrangement providing a securement of the anchor clip in any rotative adjusted position. It is also noted that the manufacturing cost of this hair roller is minimal, since relatively low cost elements form the components thereof, i.e., the low cost plastic spindle with a wire form clip 18 and a rubber band elastic retention member, which is in keeping with relatively large numbers of such hair rollers which are necessitated to carry out each hair set.

The embodiments of the invention in which an exclusive property or privilege is claimed are defined as follows:

1. A hair roller comprised of a spindle member adapted to receive a lock of hair to be wound into a curl thereon comprised of a hollow spindle member; anchoring means carried by said spindle, said anchoring means including a radial projection, said anchoring means includes an anchor clip having a closed loop section connected to said radial projection and disposed in one end of said hollow spindle member and adapted to engage the inside thereof to orient said radial projection in a radially outward orientation with respect to said hollow spindle member; means mounting said anchor clip to said spindle member comprising means resiliently retaining said loop section within said one end of said hollow spindle member including an elastic element passing through said loop section and extending through the interior of said hollow spindle member and further includes means securing said elastic element to said hollow spindle member at the opposite end portion thereof from said one end portion of said hollow spindle member; means allowing said radial projection to be angularly located with respect to said one end of said spindle member without disassembly thereof from said hair roller by pulling said loop section partially out of said hollow spindle end comprising a plurality of notches formed in the said end portion of said hollow spindle member adapted to mate with said radial projection to angularly locate said anchor clip therein, said anchor loop section locating said radial projection with respect to said hollow spindle member one end so as to insure engagement of said radial projection with one of said notches upon release of said loop section; said anchor clip comprising a wire form element having said loop section formed thereof and said radial projection formed by a section of said wire form adapted to extend radially away from said hollow spindle member when said loop section is disposed in said end portion of said hollow spindle member; said hollow spindle member being comprised of flare end portions and wherein said wire form member has an inclined side thereof extending at an angle to said projection at an angle corresponding to said angle of said flare in said end portion of said hollow spindle member.

* * * * *